US006280669B2

(12) United States Patent
Kistner et al.

(10) Patent No.: US 6,280,669 B2
(45) **Date of Patent: *Aug. 28, 2001**

(54) METHOD FOR MAKING INSULATED PRE-FORMED WALL PANELS FOR ATTACHMENT TO LIKE INSULATED PRE-FORMED WALL PANELS

(75) Inventors: Michael J. Kistner, East Amherst; Paul J. Rowe, Fairport; Kenneth J. Kistner, Getzville; William M. Kistner, Batavia, all of NY (US)

(73) Assignee: Kistner Concrete Products, Inc., East Pembroke, NY (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/120,657

(22) Filed: Jul. 22, 1998

Related U.S. Application Data

(63) Continuation-in-part of application No. 08/508,722, filed on Jul. 28, 1995, now abandoned

(60) Provisional application No. 60/082,306, filed on Jul. 28, 1997.

(51) Int. Cl.[7] ..... B29C 39/10; B29C 39/28; B29C 41/20; B32B 31/12

(52) U.S. Cl. ..... 264/135; 264/154; 264/229; 264/263; 264/275; 264/276; 264/277; 264/333; 425/DIG. 127

(58) Field of Search ..... 264/154, 277, 264/229, 261, 263, 268, 274, 275, 276, 333, 134, 135; 425/DIG. 127

(56) References Cited

U.S. PATENT DOCUMENTS

| | | | | |
|---|---|---|---|---|
| 2,634,601 | | 4/1953 | Tillery | 72/16 |
| 3,435,581 | | 4/1969 | Ahlqvist | 52/405 |
| 3,775,922 | * | 12/1973 | Myers | 52/367 |
| 4,333,290 | * | 6/1982 | Koberstein | 52/376 |
| 4,334,395 | * | 6/1982 | Dyar | 52/407 |
| 4,570,398 | | 2/1986 | Zimmerman | 52/169.11 |
| 4,605,529 | | 8/1986 | Zimmerman | 264/263 |
| 4,671,032 | | 6/1987 | Reynolds | 52/210 |
| 4,751,803 | | 6/1988 | Zimmerman | 52/414 |
| 4,934,121 | | 6/1990 | Zimmerman | 52/583 |
| 4,974,383 | * | 12/1990 | Derr et al. | 52/582 |
| 5,055,252 | | 10/1991 | Zimmerman | 264/263 |
| 5,207,045 | * | 5/1993 | Bodnar | 52/600 |
| 5,758,464 | * | 6/1998 | Hatton | 52/404.1 |

* cited by examiner

*Primary Examiner*—Jan H. Silbaugh
*Assistant Examiner*—Michael I. Poe
(74) *Attorney, Agent, or Firm*—Hayes, Soloway, Hennessey, Grossman & Hage, PC

(57) ABSTRACT

A method for making insulated pre-formed wall panels for attachment to like insulated pre-formed wall panels for building a wall. The method includes providing a mold for casting a concrete body having a generally planar portion with a plurality of rib portions extending therefrom, nesting at least one insulation strip within a respective spring member, covering the end portions of the respective spring member with a thermally insulating material to limit thermal conductivity from each respective rib portion of the concrete body to each respective spring member, inserting each respective spring member with the at least one nested insulation strip in the mold, and casting the concrete body in the mold with each respective spring member with the at least one insulation strip being unitarily attached to an edge portion of each respective rib portion with the end portion of each respective spring member being anchored in each respective rib portion of the concrete body to make the insulated pre-formed wall panel. The spring member serves as a nailer strip for the insulated pre-formed wall panel.

3 Claims, 13 Drawing Sheets

METHOD FOR MAKING INSULATED PRE-FORMED WALL PANELS FOR ATTACHMENT TO LIKE INSULATED PRE-FORMED WALL PANELS

This application is a continuation-in-part of U.S. application Ser. No. 08/508,722, filed Jul. 28, 1995 now abandoned, and a continuation-in-part of U.S. application Ser. No. 08/901,555, filed Jul. 28, 1997, by petition converted to Provisional application Ser. No. 60/082,306, filed Jul. 28, 1997. Priority is hereby claimed based on aforesaid application Ser. No. 08/508,772 and the aforesaid Provisional Application of Jul. 28, 1997.

The present invention relates generally to insulated pre-formed wall panels and to the construction of walls such as basement walls therewith.

In co-pending U.S. patent application Ser. No. 08/508,722 filed Jul. 28, 1995, the disclosure of which is incorporated herein by reference, Michael J. Kistner and Paul J. Rowe, two of the inventors for the present application, disclose a prefabricated wall panel which comprises a unitary combination of a member having a generally planar portion which has an outer surface which defines the outer surface of the erected wall and a plurality of rib portions integral with the planar portion and extending from the inner surface of the planar portion thereby defining voids therebetween for receiving insulation. The wall panel further comprises insulating material attached, as strips or otherwise suitably attached, to the edges of the rib portions which are remote from the planar portion. A nailer strip, which may be a screw nailer or other suitable means, is applied to each insulating material strip. After the prefabricated wall panels are installed and insulation is placed in the voids, wallboard defining the inner surface of the wall is attached to the nailers to complete the wall construction. Such a prefabricated panel is thus provided to eliminate conductive pathways between the rib portions and the wallboard so that greater insulative capability may be achieved in a panel from which a wall may be easily yet reliably and inexpensively erected.

The aforesaid application also discloses an embodiment of the nailer strip which is composed of a spring material and which is folded to extend around sides of the respective insulation material strip, and a pair of edge portions thereof extend into the respective rib portion for anchoring the nailer strip and the insulation material strip to the rib portion.

It is an object of the present invention to enhance the insulation capability of the panels.

It is another object of the present invention to improve the stability of walls constructed and being constructed with the panels.

It is a further object of the present invention to improve the quality and appearance of walls constructed with the panels.

It is yet another object of the present invention to provide a seismic resistant attachment of the panels to floor slabs.

In order to enhance the insulation capability of a panel, in accordance with the present invention, the edge portions of the nailer strip are insulated from the rib portion to limit thermal conductivity from the rib portion to the nailer strip.

In order to improve the stability of a wall constructed and being constructed with the panels, in accordance with the present invention, a corner panel is provided which "braces" a wall portion to which the free-standing corner panel is attached. Corner panels are also provided, in accordance with the present invention, to achieve a "bay window" effect or the like to meet aesthetic or functional requirements.

Further in accordance with the present invention, one or more first block-outs for forming the rib portions which extend from the inner surface of a first planar portion are removed from a molded corner wall panel while the molded corner wall panel is held stationary after which one or more second block-outs for forming the rib portions which extend from the inner surface of a second planar portion which forms a corner with the first planar portion are then removed from the molded corner wall panel.

In order to provide a seismic resistant connection of a panel to a floor slab, the nailer strip for a corresponding horizontal rib portion thereof is nailed or otherwise suitably attached to the floor slab, and a cushion material is disposed between the nailer strip and floor slab to allow some movement therebetween.

The above and other objects, features, and advantages of the present invention will be apparent in the following detailed description of the preferred embodiments thereof when read in conjunction with the accompanying drawings wherein the same reference numerals denote the same or similar parts throughout the several views.

DETAILED DESCRIPTION OF THE PREFERRED EMBODIMENT

Figure 1:
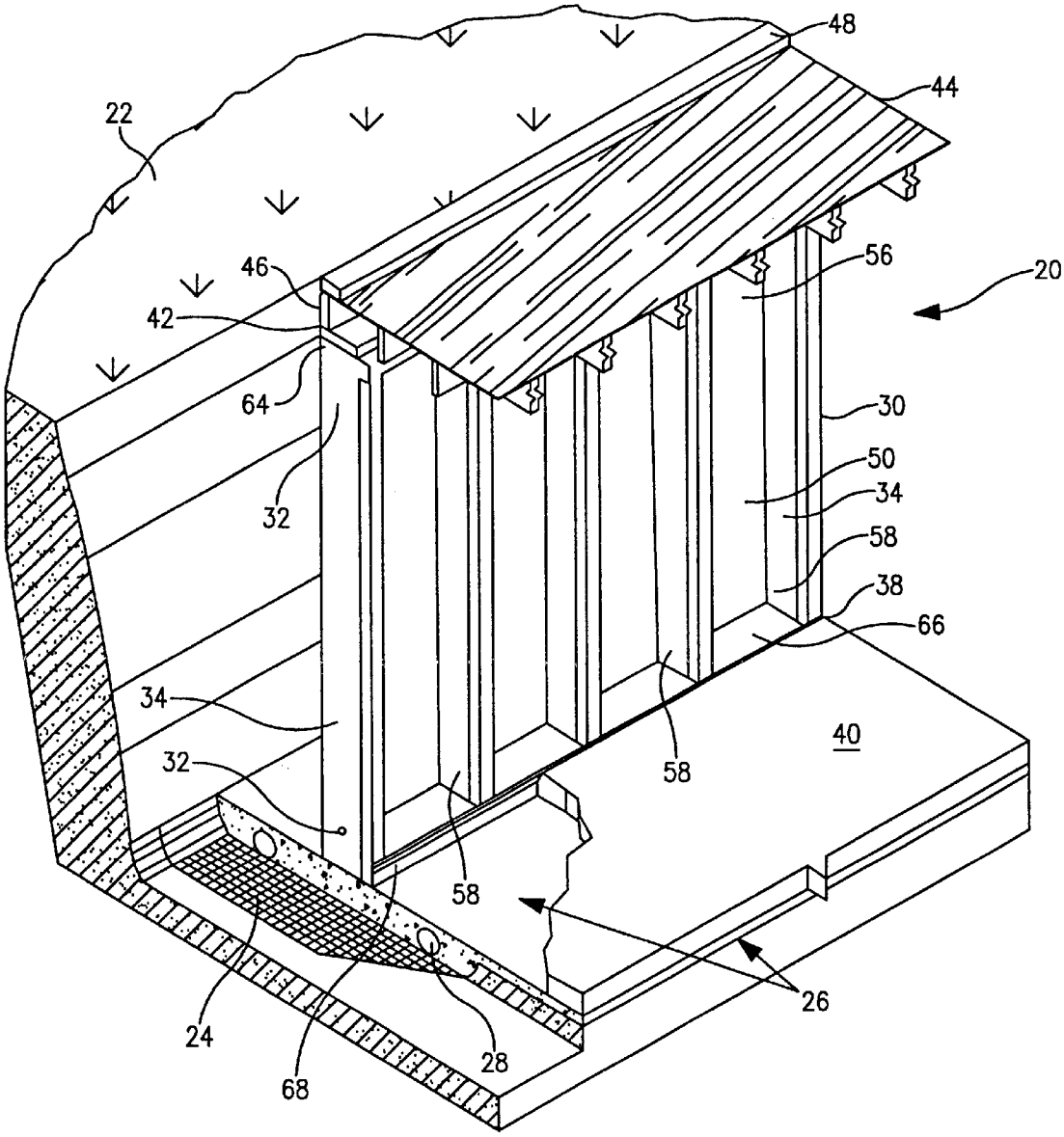
FIG. 1 is a perspective view, with parts cut away, of an unfinished wall portion which embodies the present invention.
Figure 4:
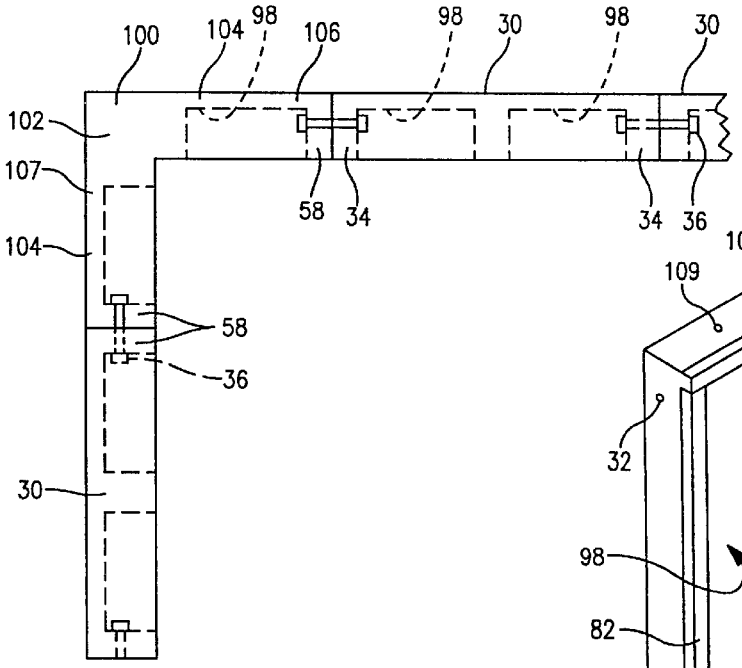
FIG. 4 is a schematic plan view of a wall portion which contains the corner wall panel.

Referring to FIG. 1, there is shown generally at 20 a portion of a basement wall placed below ground, illustrated at 22. It should of course be understood that the present invention is also applicable to above-ground walls. The ground is suitably prepared such as by applying a suitable filter fabric, illustrated at 24, then applying perhaps a 6 inch thick layer 26 of cleaned crushed stone (compacted perhaps about 99%). Suitable drain pipes 28 (perhaps 4 inch perforated) embedded in the layer of crushed stone provide drainage to a daylight drain or sump pump. A plurality of insulated pre-formed wall panels 30 (one shown in FIG. 1) are stood on top of the crushed stone layer 26 in side edge-to-side edge relation, as illustrated in FIG. 4, to form the wall.

The term "pre-formed", as used herein and in the claims, is meant to refer to panels which have been formed (such as pre-cast) at a first site and then transported to a second site for the building of a wall therewith. A wall built with such a pre-formed or pre-fabricated panel is thus distinguished from a poured-in-place wall wherein the wall is formed on-site.

Several embodiments of the wall panel 30 are disclosed in the aforesaid patent application, and an embodiment thereof will be described hereinafter with reference to FIG. 1. The wall panels 30 are joined by suitable means such as aligned upper and lower apertures, illustrated at 32, in side edge or outer rib portions 34 in which fasteners such as bolts 36 are received, as seen in FIG. 4. A screed board 38 is applied along the upper edge of the wall panel footing, and a concrete floor 40 is suitably poured. Nailers 42 are applied to the upper surfaces of the wall panels 30 by suitable means such as, for example, carriage bolts (not shown) received in wall panel apertures, illustrated at 109 in FIG. 3, for a corner panel, and in nailer apertures (not shown). A suitable floor, illustrated at 44, including headers 46 and soles 48, is constructed to overlie the basement floor 40. As discussed in the aforesaid patent application, the pre-formed insulated wall panels 30 may be formed at a central location and transported to a building site where the wall portions 30 are joined in erecting the wall 20. This allows the wall to be easily, quickly and efficiently erected.

Figure 2:
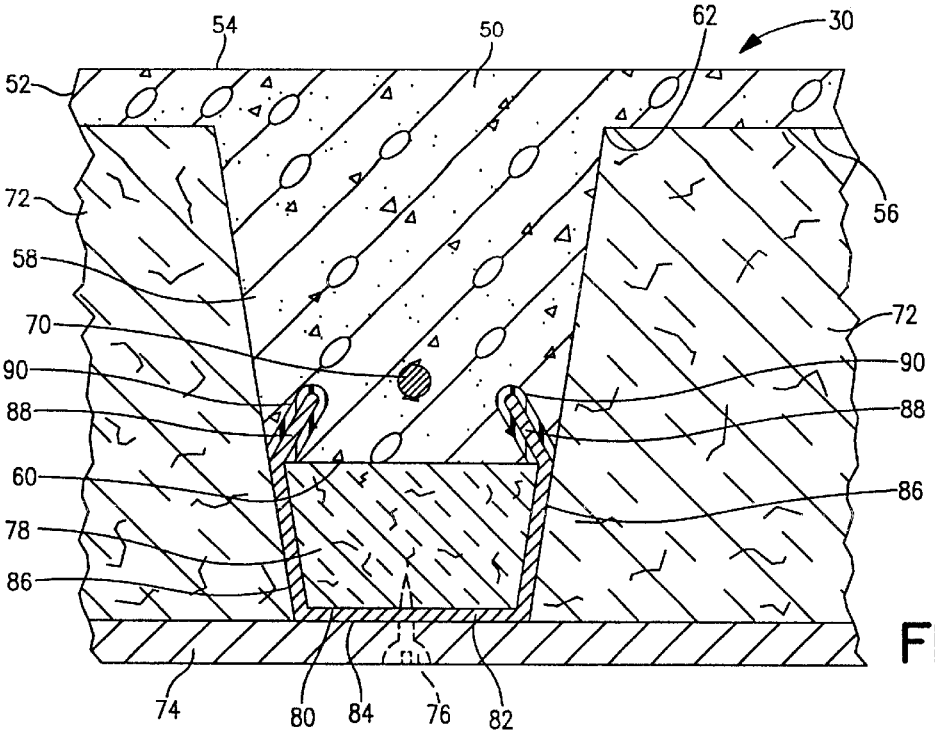
FIG. 2 is a horizontal sectional view of a portion of a finished wall panel for the wall of FIG. 1.

Referring also to FIG. 2, a panel 30 comprises a member 50 which is an integral or monolithic load-bearing structure pre-cast of concrete or otherwise suitably composed of a suitable material which would be considered equivalent thereto. The member 50 includes a generally planar vertical laterally-extending rectangular portion 52 having outer and inner surfaces 54 and 56 respectively, the outer surface 54 serving as the outer surface of the wall 20 constructed therewith. Integrally connected to and formed with the planar portion 52 are a plurality of laterally spaced vertical rib portions 58 which extend from the inner surface 56 and which terminate at edges 60 which are remote from the planar portion 52, i.e. an edge 60 is opposite to the location 62 of joinder of a rib portion 58 with the planar portion 52. As used herein and in the claims, the term "remote" is understood to be with reference to a laterally extending planar portion of a panel. The rib portions 58 preferably extend over the entirety of the panel height and perpendicular to the planar portion 52. The outer ones of the rib portions 58 are the side edge portions 34. The member 50 also includes upper and lower transverse or horizontal rib portions 64 and 66 respectively which are also formed integrally with the planar portion 52 and the vertical rib portions 58 and which define the upper and lower edges respectively of the panel 30. The lower rib portion 66, which in the wall 20 is in contact with the ground, extends inwardly beyond the remote edges 60 of the other rib portions 58 to maximize the load-bearing capability thereof for increased stability. Thus, the lower rib portion 66 terminates at remote edge 68 which is co-extensive with the inner surface of the unitary panel. If a panel were constructed to rest on top of another panel so as to be above the ground, as illustrated in FIGS. 11 to 15 and discussed hereafter, then the lower rib portion 66 may desirably be formed to be similar to the other rib portions and provided with insulative capability, as hereinafter discussed. The integral pre-cast concrete member 50 may be suitably reinforced with rebar 70 or other suitable reinforcement.

After the panels 30 are placed in position at the wall construction site, a suitable caulking is applied therebetween for sealing. The caulking material is preferably urethane material which provides strength, longevity, and water tightness. The panels are then suitably connected together, and individual masses of suitable insulation 72 are disposed in the voids or gaps illustrated at 98 in FIG. 4, the insulation defined as lying between and bounded by the respective rib portions and the planar portion. These masses of insulation 72 may desirably be fiberglass or other suitable insulation and preferably fill the entire space of each void. After the insulation is installed, wallboard 74 is then suitably affixed, as described hereinafter, by suitable attachment means such as screws 76 to finish the wall.

Concrete is considered to be a good conductor of heat and therefore a poor insulator. If the wallboard 74 were connected directly to the rib edges 60, there would be pathways from the rib portions 58 to the wallboard 74 for conduction of heat and cold which would reduce the insulation capability of the panels. In order to eliminate such pathways, individual strips of insulating material 78 such as, for example, expanded polystyrene foam are unitarily attached to the edges 60 in various ways as discussed in the aforesaid patent application including as discussed hereinafter with reference to FIG. 2. The insulating material strips 78 suitably have a width and height equal substantially to that of the respective edges 60 to which they are joined and extend inwardly therefrom to terminate at inner remote edges 80. A similar strip of insulating material is attached to the inner edge of the upper horizontal rib portion 64 (where the wall panel is installed above or in a basement) as well as to the lower horizontal rib portion when the wall panel is installed, for example, above the basement.

Figure 1A:
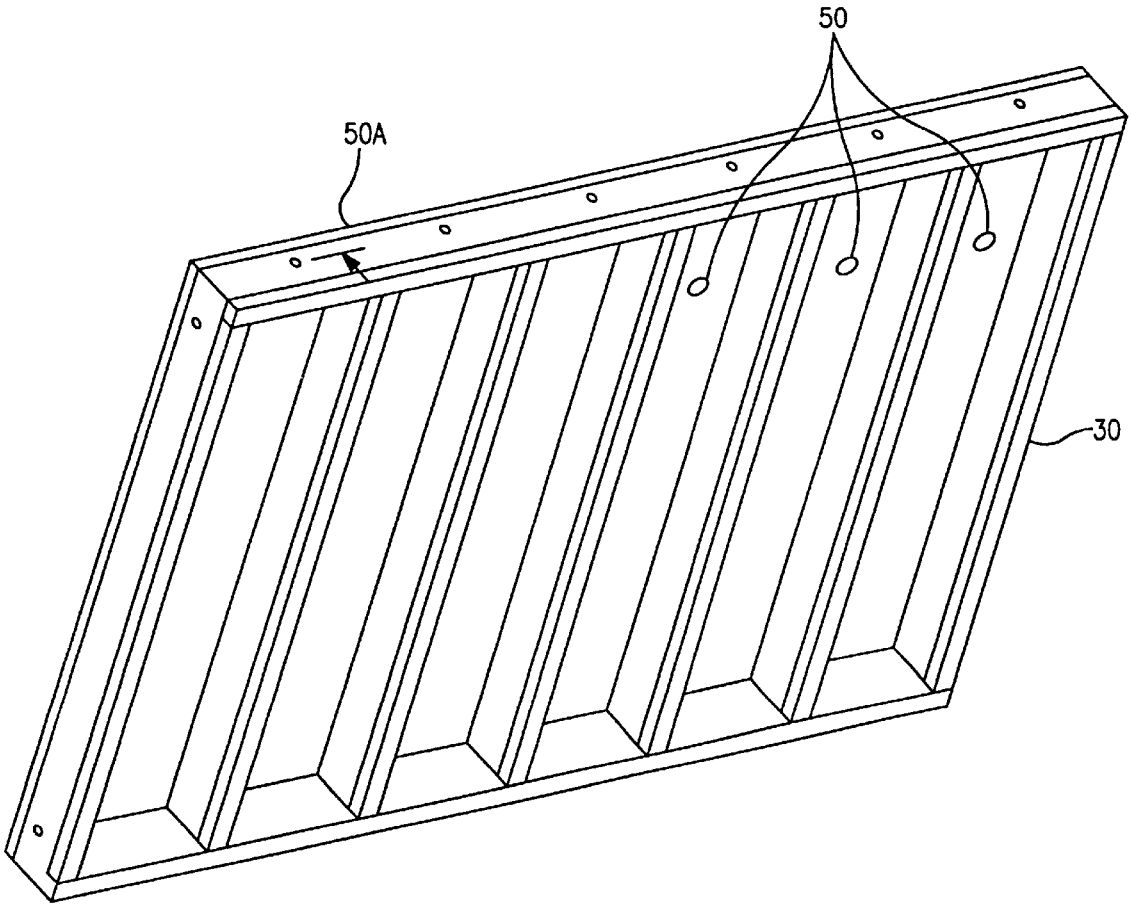
FIG. 1A is a perspective view of an alternative embodiment of wall panel made in accordance with the present invention.

Alternatively, as shown in FIG. 1A, panel 30 may include a lightweight, thermally insulative, concrete face panel 50A serving as the outer surface of the panel. For ease of construction, face panel 50A may be pre-cast, and placed in the mold prior to pre-casting panel 30. Alternatively, face panel 50A may be formed in-situ on a pre-cast panel 30, or separately formed and fixed thereto, e.g. by means of an adhesive or fasteners. Panel 50A may also be formed of a pre-formed foam plastic or the like, faced with a thin layer of concrete.

Wood, when used as a nailer, may have a tendency to deflect. In order to eliminate such deflection as well as to achieve a good finish to the panels for a good appearance, a steel or other suitably metallic or composite nailer strip 82 is provided to receive the screws 76 for attachment of the wallboard 74, the nailer preferably extending over the height of the respective rib 58. Similar nailer strips are provided for the upper horizontal rib as well as for the lower horizontal rib when a strip of insulation material is applied therto. By the term "nailer" is meant, for the purposes of this specification and the claims, a member which serves as a means for attaching wallboard by any suitable means including screws and adhesive as well as nails. The nailer 82 is bent or otherwise suitably formed to generally surroundingly engage or tightly nest the insulation strip 78 and in anchored at its longitudinal edges in the concrete member 58 to hold itself and the insulative strip 78 securely attached to the remote end of the respective rib. This composite cast of the nailer 82 in the concrete rib 58 is labor saving. More specifically, the nailer 82 has a central portion 84 which engages or extends alongside the remote or inner edge 80 of the insulation member 78 and may, if desired, be adhesively attached thereto, a pair or portions 86 which extend from the central portion 84 alongside the sides of the insulation member 78, and a pair of edge portion 88 which extend therefrom outwardly (toward the planar portion 52) and toward each other into the respective rib portion 58 to be anchored therein. In order to provide a tight fit between the nailer side portion 86 and the respective walls of the mold to prevent cement from getting therebetween, resulting in an aesthetically displeasing appearance to the finished panel, the nailer 82 is preferably composed of spring steel (or other suitable spring metal or composite) so as to tightly engage the walls of the mold during panel formation.

Figure 16:
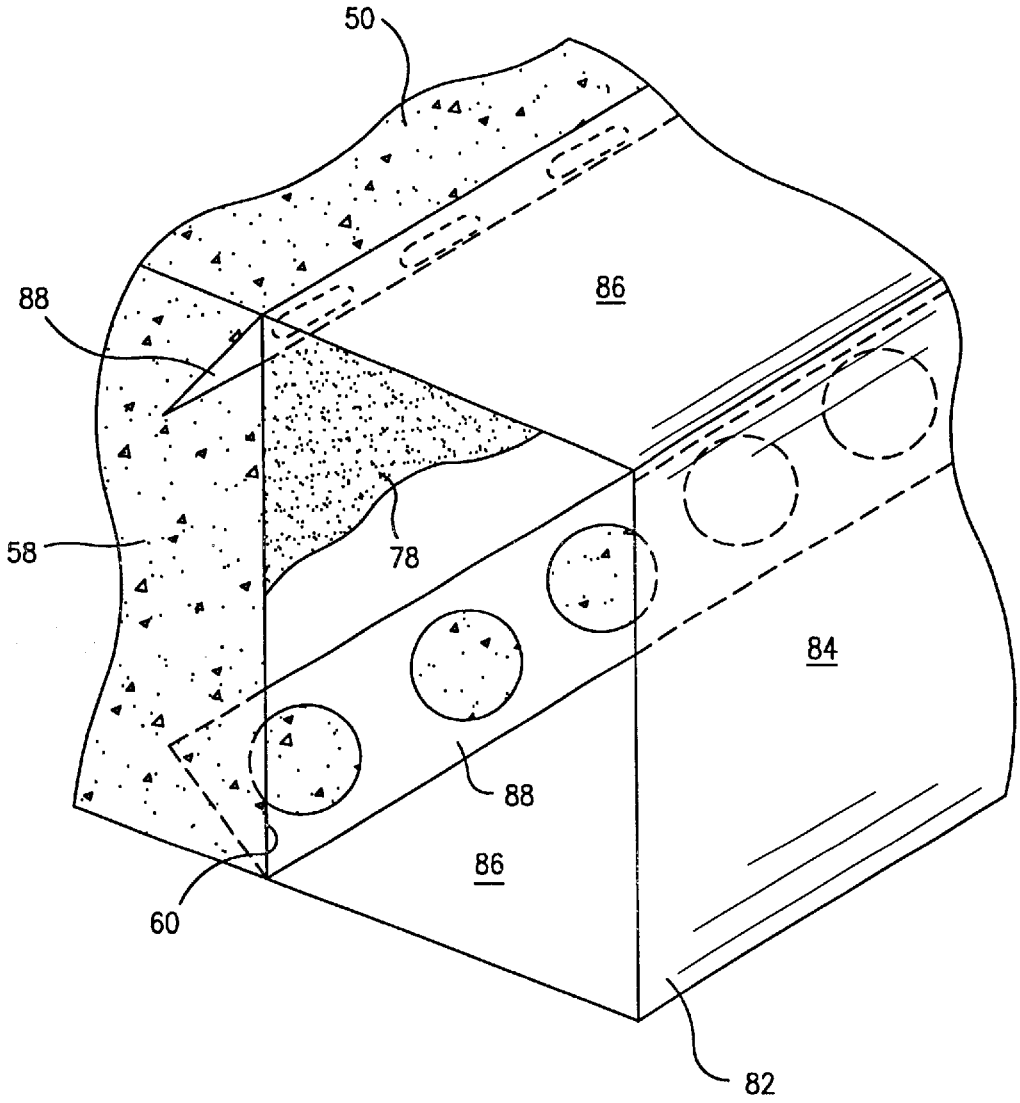
FIG. 16 is a partial perspective view, with a portion of an insulation strip cut away, of the wall panel of FIG. 2.

While the provision of the insulation strips 78 along with the insulating material 72 provides good insulating capability of the panel 30, there are still conduction pathways from the concrete ribs 58 to the respective nailer edge portions 88 then along the respective nailer side portions 86 to the wallboard 74. In order to block these pathways so as to even further limit thermal conductivity between the concrete ribs 58 and the wallboard 74 for even better insulating capability, in accordance with the present invention, each of the nailer edge portions 88 is covered with a suitable insulating material, illustrated at 90, such as, for example, epoxy, urethane, plastic, or a suitable elastoner. The nailer edge portions 88 may, for example, be dipped in a suitable insulating material which is then allowed to harden thereon before the nailer is placed in a mold for pre-forming the panel. The nailer edge portions 88 may also be suitably pre-punched with holes, illustrated at 89 in FIG. 16, to further reduce heat transfer as well as to provide for utility runs within the wall and to save labor during wall construction.

The provision of the steel nailer 82 in composite with the concrete rib 58 provides additional steel reinforcing to the concrete wall. By its position along the exterior of the concrete rib 58, the effect of its strength is maximized due to its increased distance from the neutral axes. As a result, the size of the reinforcing rebar 70 may be reduced, in accordance with the present invention, from 5 bar to perhaps 4 bar for cost savings.

Figure 3:
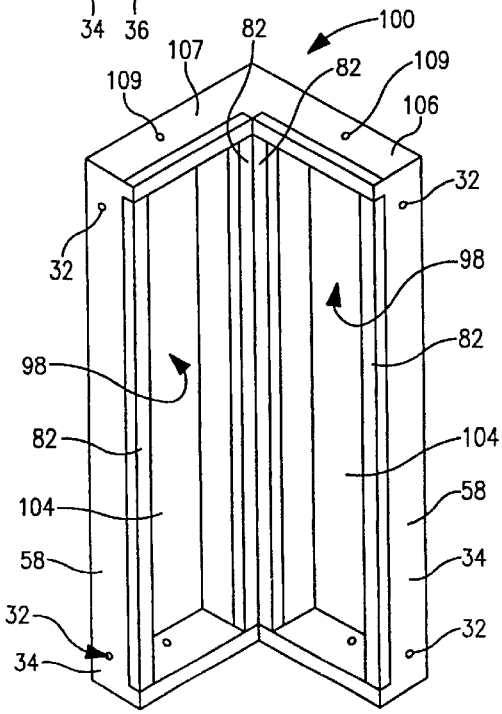
FIG. 3 is a perspective view of a corner wall panel in accordance with an alternative embodiment of the present invention.
Figure 7:
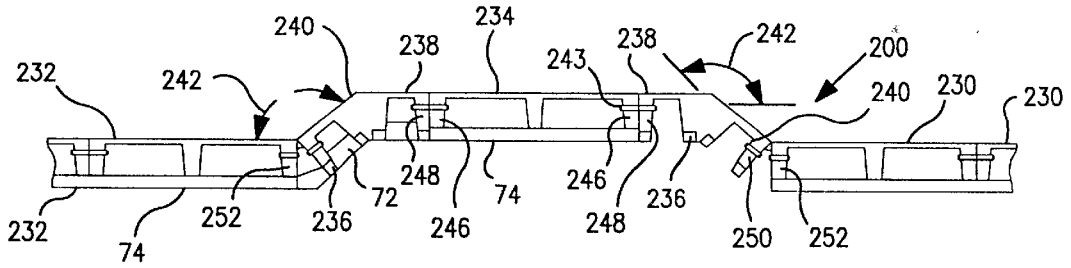
FIG. 7 is as a schematic plan view of a portion of a wall which contains a corner wall panel in accordance with another embodiment of the present invention.

As the walls are being erected, the wall stability may be such that there may be a tendency for them to fall over before joinder is completed. Referring to FIGS. 3 and 4, in order to provide stability to portions of the walls 20 while under construction in accordance with the present invention, a monolithic corner panel, shown generally at 100, is provided. The corner panel 100 is similar to panel 30 except as described herein. The corner panel 100 is pre-cast to have a generally cross-sectionally square or post portion, illustrated at 102, at its corner, and a pair of planar portions 104 extend therefrom in directions perpendicular to each other to provide legs 106 and 107 which are perpendicular to each other. However, it should be understood that the planar portions 104 may extend in directions other than perpendicular to each other, as illustrated in FIG. 7 for a bay window. Thus, as used herein and in the claims, the term "corner" is meant to refer to a panel wherein planar portions defining wall portions thereof extend in different directions. Each leg 106 and 107 may, for example, be about 3 feet in length. Each leg 106 and 107 may of course have any desired number of ribs 58. The legs 106 and 107 act as "braces" to support the corner panel 100 and any panels 30 attached thereto in an upright position so that they do not fall over during construction.

Figure 5:
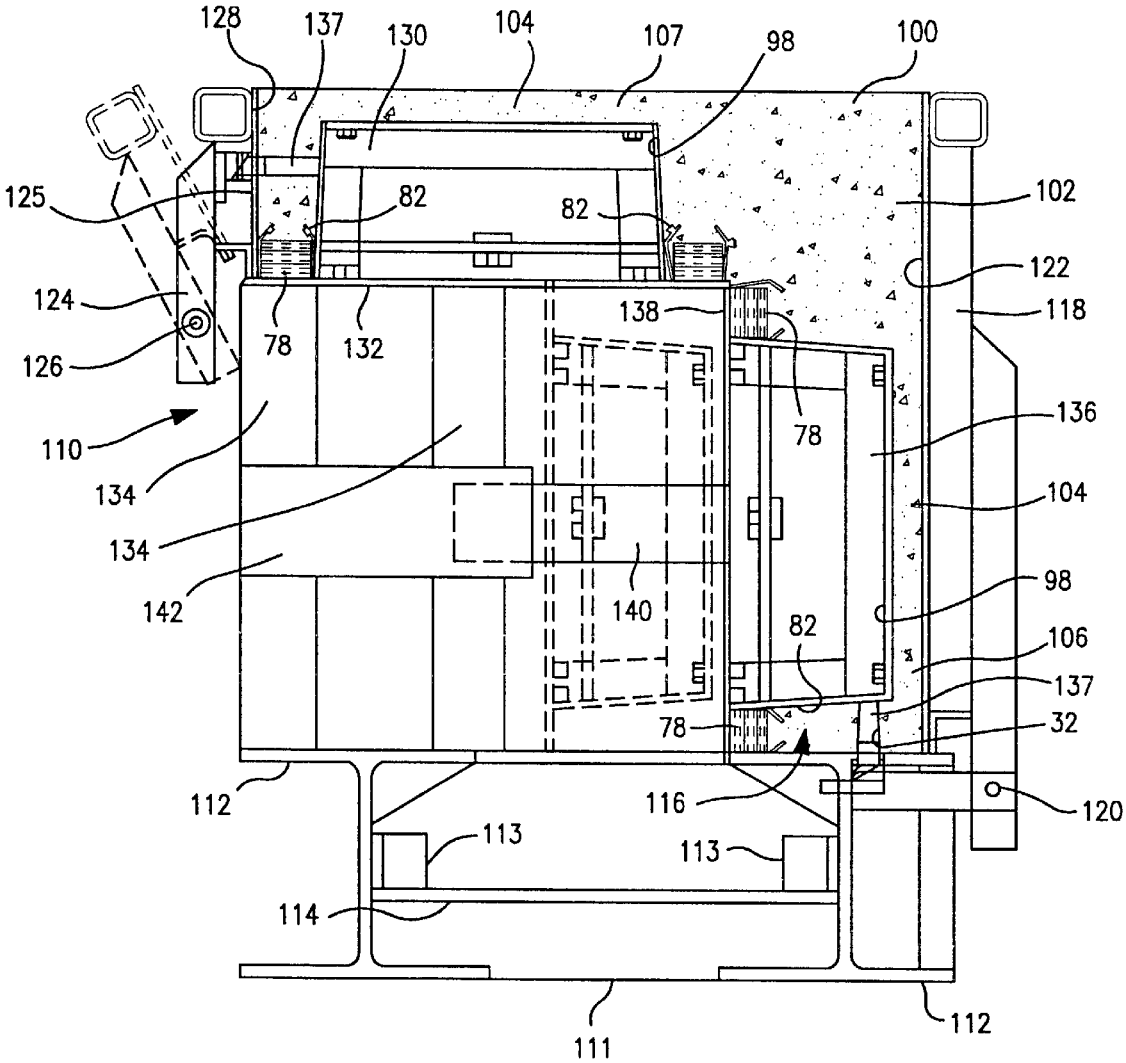
FIG. 5 is a schematic sectional view of a mold and illustrating a corner wall panel made therewith in a sectional view similar to that of FIG. 2.

Referring to FIG. 5, there is illustrated generally at 110 a mold in which the corner panel 100 is formed. The mold components as illustrated extend generally over the mold length which defines the corner member height, i.e., in a direction normal to the plane of FIG. 5, and the mold is suitably enclosed, in accordance with principles commonly known to those of ordinary skill in the art to which this invention pertains, at its ends. The mold 110 includes a support framework 111 including a pair of parallel beams 112, a pair of angle irons 113, and channel 114 extending between the beams and welded thereto and providing a surface 116 for defining the end of one of the legs 106, i.e., a leg which is vertical when cast. A frame structure 118 is pivotally supported by framework 111 as by pivot 120 and extends upwardly therefrom to provide a vertical surface 122 for defining the vertical exterior surface of the vertical leg 106. Another frame structure 124 is pivotally supported as by pivot 126 and extends upwardly therefrom and carries a wall 125 to provide a vertical surface 128 for defining the end of the other or horizontal leg 107. Each of the frame structures 118 and 124 is thus pivotally movable into position for casting the corner panel 100, as seen in FIG. 5, and pivotally movable away from the casting position, as seen in dashed lines for frame structure 124, to allow "collapsing" of the mold 110 for removal of the cast corner panel 100 therefrom as discussed hereinafter.

A conventional block-out 130 is supported by frame member 132 for forming the void 98 in leg 107. The frame member 132 defines the interior surface of leg 107. The frame member 132 is suitably supported by one or more pairs of spaced tubular members 134 which are in turn supported by support structure 111. The pairs of tubular members are suitably spaced over the mold length.

Another block-out 136 is supported by cylinder 142 for forming the void 98 in leg 106. A frame member 138 defines the interior surface of leg 106. The frame member 138 is carried by a rod 140 of cylinder 142 for movement of block-out 136 horizontally into position, as shown in FIG. 5 for casting, and horizontally away from the casting position, as illustrated by dashed lines in FIG. 5. Plugs 137 are suitably provided to extend from the frame structures 111 and 124 to form apertures 32. The block-outs 130 and 136 and plugs 137 are suitably tapered to allow their easy removal from the cast corner panel 100.

In order to cast the corner panel 100, the block-out 136 is moved horizontally, by means of hydraulic cylinder 142 or otherwise as suitable, to the casting position, and the insulation strips 78 and nailers 82 suitably positioned adjacent the respective block-outs. The frame structures 118 and 124 are also pivotally moved into the casting position. The corner panel 100 may then be poured and cast. In order to remove the cast corner panel 100, in accordance with the present invention, the block-out 136 is moved horizontally out of the cast corner panel 100 by means of hydraulic cylinder 142, with the cast corner panel 100 held stationary during its removal. The mold 110 may then be "collapsed" by pivotally moving frame structures 118 and 124 away from the cast corner panel 100, and the plugs 137 are removed. The cast corner panel 100 may then be freed from the mold 110 by lifting it away (upwardly as seen in FIG. 5) from block-out 130.

Figure 6:
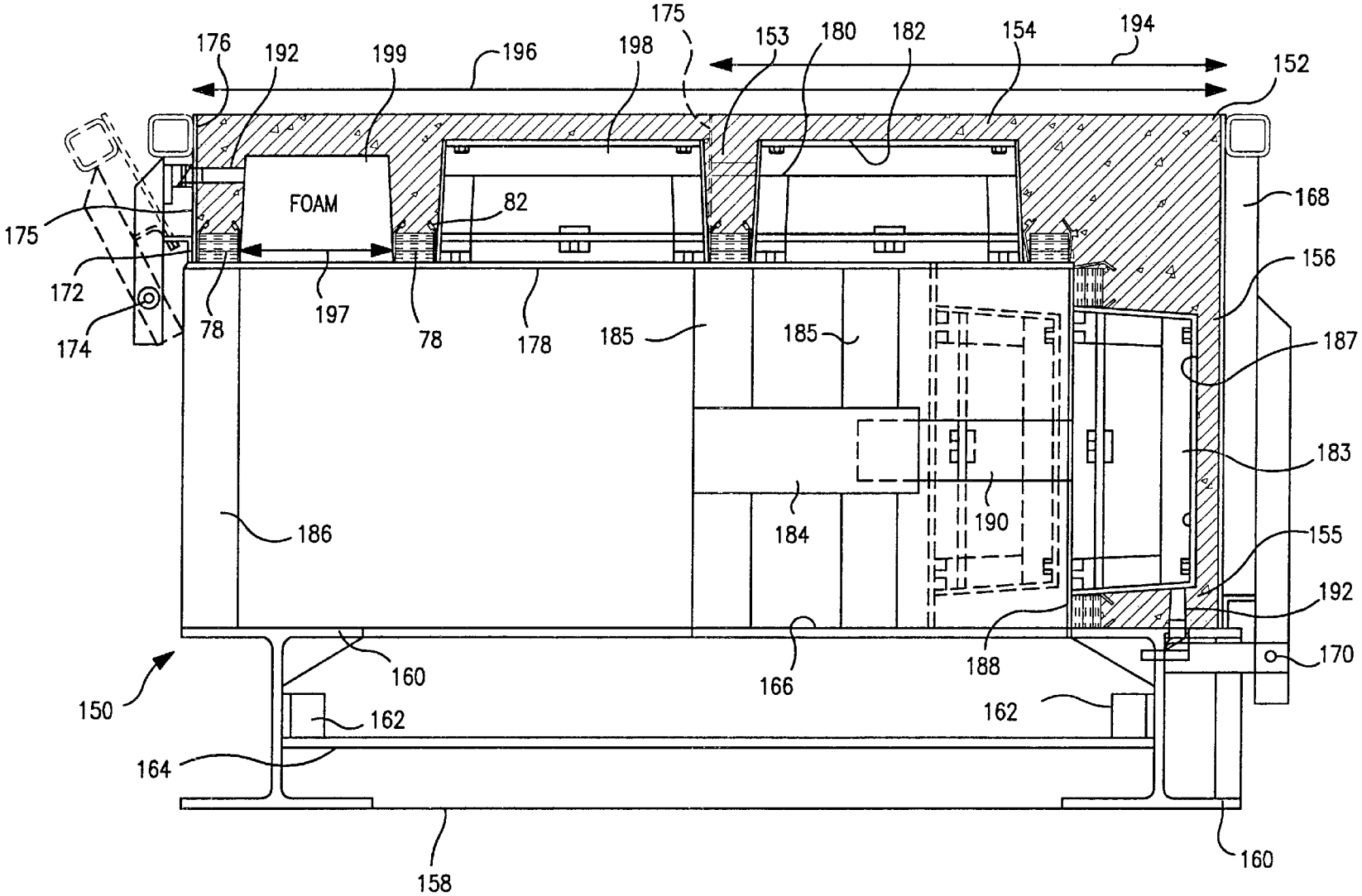
FIG. 6 is a view similar to that of FIG. 5 illustrating changes to the mold for making a corner wall panel having a length adjustable leg.

Referring to FIG. 6, there is illustrated generally at 150 a mold, which is modified from the mold 110 of FIG. 5, for providing a corner panel 152 having legs 153 and 155 which include wall defining planar portions 154 and 156 respectively.

In order that a single mold may be used to mold corner panels having a variable length planar portion, the length of one of the planar portions 154 is preferably adjustable between lengths illustrated at 194 and 196, which may, for example, be about 3 feet and 6 feet respectively. Frame structure 172 is movable along the length of frame member 178, as illustrated by dashed lines, and its wall 175 attachable thereto such as, for example, by clamps or other suitable fixture means to provide a dummy partition wall for adjustably defining the end of leg 153.

As the length of leg 153 is increased, additional tapered block-outs or pans 198 may be removably supported on frame member 178, and a tapered block-out foam member 199 may be sized to an appropriate length, illustrated at 197, for the adjusted leg length 196 and inserted to also be supported on frame member 178 for forming a void of an appropriate length for the adjusted leg length 196. After the length of leg 153 is adjusted to the desired length and the block-outs positioned, the insulation strips 78 and nailers 82 are suitably positioned adjacent the respective blockouts, and the corner panel 152 is suitably cast and removed similarly as previously discussed for the corner panel 100 of FIG. 5. The mold 150 includes a support framework 158 including a pair of parallel beams 160, a pair of angle irons 162, and channels 164 extending between the beams and welded thereto and providing a surface 166 for defining the end of leg 155. This support framework 158 extends over a length equal to the greatest length of planar portion 154 to be constructed with the mold. A frame structure 168, similar to frame structure 118, is pivotally supported by framework 158 as by pivot 170 for defining the exterior surface of the leg 155. Frame structure 172, which is similar to frame structure 124, is pivotally supported as by pivot 174 to provide wall 175 having a vertical surface 176 for defining the end of leg 153. Like frame structures 118 and 124, these frame structures 168 and 172 are each pivotally movable into position for casting the corner panel 152 and pivotally movable away from the casting position, as seen in dashed lines for frame structure 172, to allow "collapsing" of the mold for removal of the cast corner panel 152 therefrom.

Frame member 178 also supports a conventional block-out 180 for forming a void 182 in leg 153. The frame member 178 defines the interior surface of leg 153 and thus has a length corresponding to the greatest length of planar portion 154 of a corner panel to be constructed with the mold 150. The interior end portion of the frame member 178 is suitably supported by one or more pairs of spaced tubular members 185, and the exterior end portion thereof is suitably supported by one or more tubular members 186, the tubular members 185 and 186 being suitably spaced over the mold length. The tubular members 185 and 186 are in turn supported by support structure 158.

Another block-out, similarly as for block-out 136, is suitably supported by cylinder 184 for forming a void 187 in leg 155. A frame member 188 is carried by a rod 190 of cylinder 184 for movement of blockout 183 into and out of position for casting and for removal, as illustrated by dashed lines in FIG. 6, from the casting position respectively. Plugs 192 are suitably provided to extend from the respective frame structures to form apertures in the end walls for attachment of the corner panel 152 to other wall panels. The plugs as well as block-outs may be tapered to allow their easy removal from the cast corner panel 152.

Figure 8:
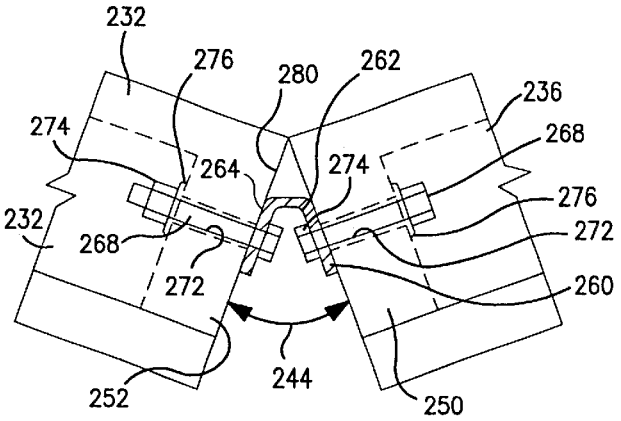
FIG. 8 is an enlarged partial top view thereof illustrating attachment of the corner panel of FIG. 7 to another wall panel.
Figure 9:
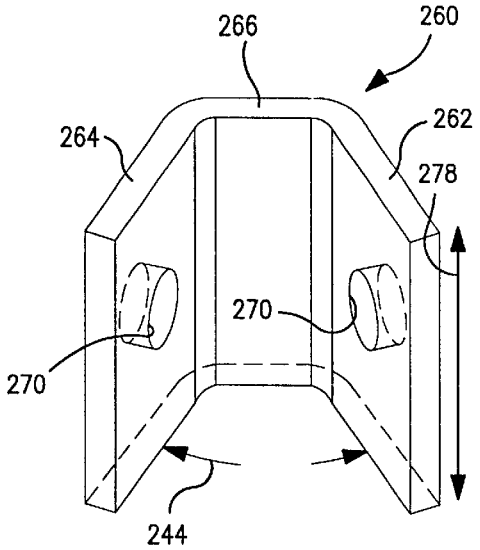
FIG. 9 is an enlarged perspective view of a connector member for connecting the corner panel of FIG. 7 to the other wall panel.

Referring to FIGS. 7 to 9, there is illustrated generally at 200 a section of a wall containing first and second pluralities of wall panels 230 and 232, which are similar to wall panels 30 and which are aligned longitudinally with each other, i.e., the panels 230 are aligned longitudinally with the panels 232. The left side of FIG. 7 shows the wall section finished with wall board 74 and insulation 72, and the right side is shown unfinished. One (or more, longitudinally aligned) other wall panel 234, which is also similar to wall panel 30, is offset from but extends parallel to panels 230 and 232, i.e., its longitudinal axis is spaced from and parallel to the longitudinal axes of panels 230 and 232.

Interconnecting one end wall of panel 234 and a corresponding end wall of the corresponding panel 230 is a wall panel 236. Interconnecting the other end wall of panel 234 and a corresponding end wall of the corresponding panel 232 is another wall panel 236. The insulation materials 72 are disposed only part way back in the voids in order to create an insulative dead air space, for reduced insulation cost. Wall panels 236 are corner wall panels wherein the wall-defining planar portions 238 and 240 thereof extend at an angle, illustrated at 242, of, for example, 135 degrees relative to each other. Thus, panels 234 and 236 define a wall portion in which, for example, a bay window may be installed.

The end walls 248 of corner panels 236 are flush with and are connected to the respective end walls 246 of panel 234 as by bolts 243. However, as seen in FIG. 7, the other end walls 250 of corner panels 236 are not flush with the corresponding end walls 252 of corresponding panels 230 and 232 but instead are oriented at an angle, illustrated at 244, relative thereto which may, for example, be about 45 degrees (180 degrees−135 degrees). Disposed within the resultingly cross-sectionally triangular space between end walls 250 and 252 is a clip or bracket 260 which is a sheet of plastic or other suitable material having a thickness of, for example, ⅜ inch and which is formed to have a pair of portions 262 and 264 which extend at the angle 244 relative to each other so that they lie flush with end walls 250 and 252 respectively and further to have a central portion 266 therebetween. The portions 262 and 264 are suitably attached to end walls 250 and 252 respectively such as by bolts 268, which are received in bracket apertures 270 and panel apertures 272, and nuts 274 and washers 276. The clip 260 may have a height, illustrated at 278, of, for example, about 4 inches and may be centrally located along the heights of the corresponding panels. Alternatively, its height may be as much as the heights of the corresponding panels, or more than one such clip may be provided over the panel height. Filling the cross-sectionally triangular space back of the central portion 266 of the clip 260 is a wedge 280 of plastic or other suitable material which is similarly cross-sectionally triangular in shape. This wedge 280 extends over the height of the panel and is sealed to the end walls 250 and 252 and central portion 266 by a polyurethane elastomeric material such as Sikaflex material or other suitable material.

Figure 10:
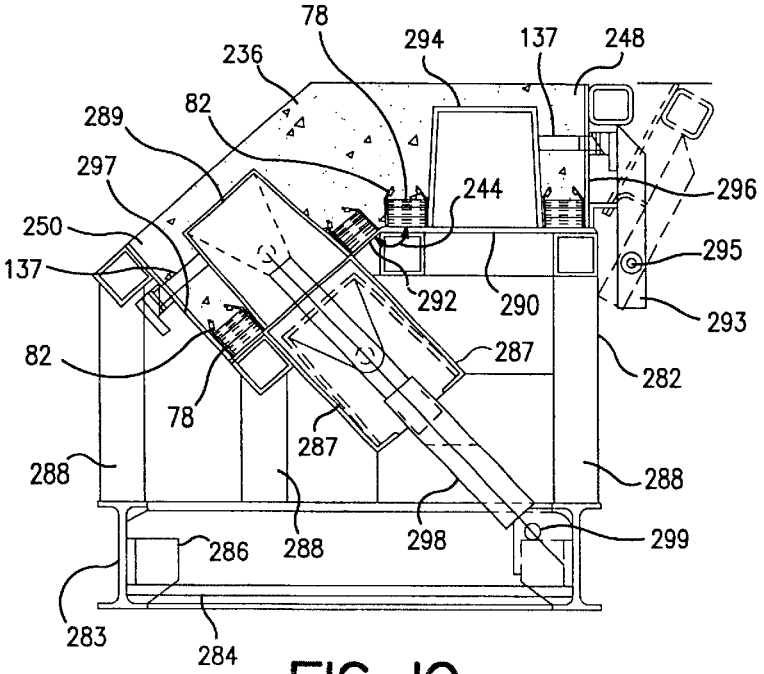
FIG. 10 is a view similar to that of FIG. 5 of a mold which embodies the present invention and of the corner panel of FIG. 7 made therewith.

Referring to FIG. 10, there is illustrated generally at 282 a mold for making the corner panel 236. The mold 282 includes a suitable support structure such as beams 283, channels 284, and angle irons 286 which form a suitable platform for tubular support members 288, which are supported thereby, support frame member 290, which lies horizontal, and frame member 292, which lies at angle 244 relative to frame member 290. The frame member 290 supports a suitably tapered block-out 294 and insulation strips 78 and nailers 82 on the sides thereof. Frame structures 293 and 297 are also provided for forming the end walls 248 and 250 respectively. Frame structure 293 is, similarly to frame structure 124 in FIG. 5, pivotally supported by pivot 295 to allow "collapsing" of the mold for removal of the cast corner panel 236 and extends upwardly therefrom and carries a wall 296 to provide a vertical surface for defining end wall 248. Frame structure 297 comprises a wall which provides a vertical surface for defining end wall 250. A hydraulic cylinder 298 is pivotally mounted as by pivot 299 to extendibly and retractably support a suitably tapered block-out 289. The cylinder 298 and retracted block-out 289 are supported between suitable support members 287 which are suitably connected to frame member 292. Suitable tapered plugs 137 are also provided for forming apertures 272.

In order to form the corner panel 236, the block-out 289 is extended into the casting position by hydraulic cylinder 298 or otherwise as suitable, and the insulation strips 78 and nailers 82 are positioned adjacent the respective block-outs. The frame structure 293 is pivotally moved into the casting position. The corner panel 236 may then be poured and cast. In order to remove the cast corner panel 236, the block-out 289 is retracted out of the cast corner panel 236 by means of hydraulic cylinder 298, with the cast corner panel 236 held stationary during its removal. The mold 282 may then be "collapsed" by pivotally moving frame structure 293 away from the cast corner panel 236, and the tapered plugs 137 are removed. The cast corner panel 236 may then be freed from the mold 282 by lifting it away (upwardly as seen in FIG. 10) from block-out 294.

Figure 11:
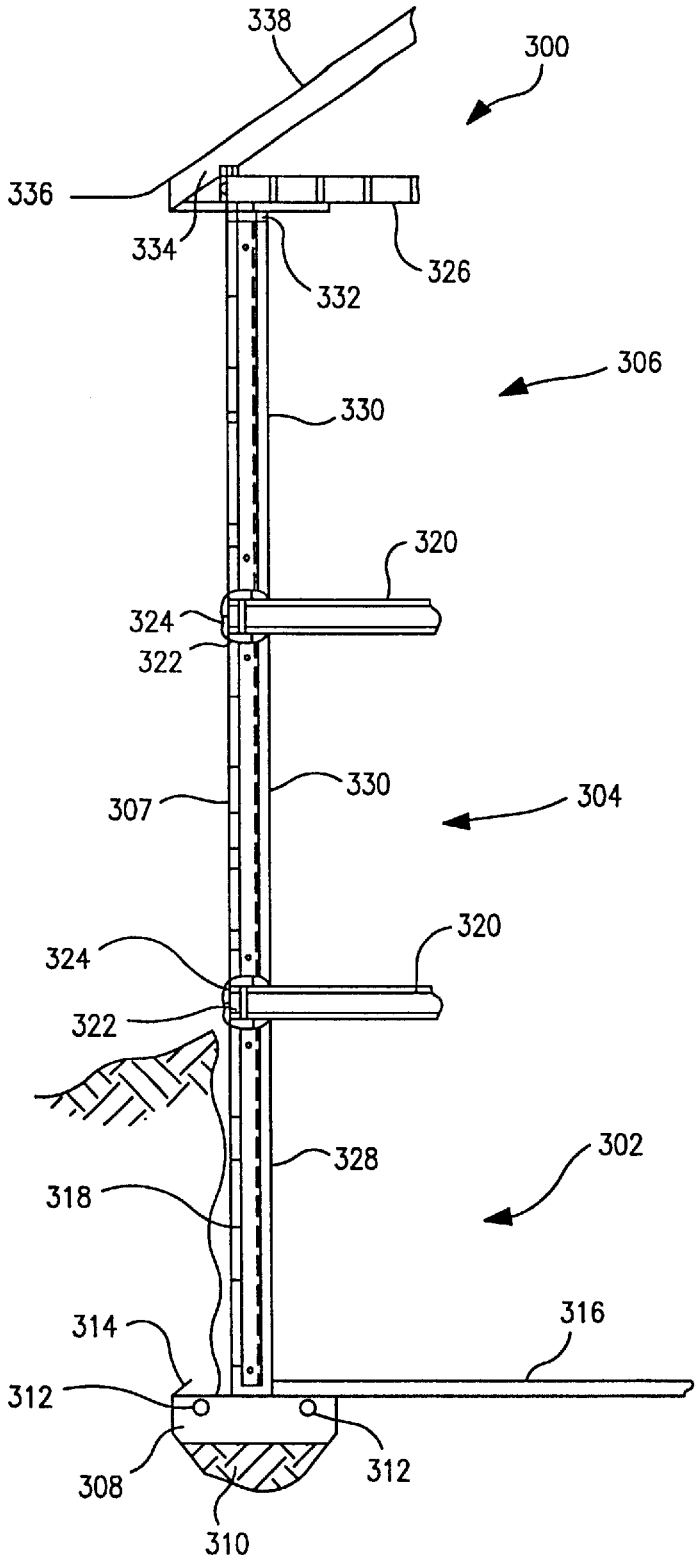
FIG. 11 is a partial schematic view of a building in accordance with an alternative embodiment of the present invention.

Referring to FIG. 11, there is illustrated generally at 300 a portion of a building having a basement and first and second floors, illustrated at 302, 304, and 306 respectively. The building 300 is constructed by laying a layer 308 of stone to a thickness of, for example, about 12 inches over virgin soil 310 and installing conventional under drain piping 312 (for example, 4 inch diameter) within the stone layer. Suitable filter fabric, illustrated at 314, is applied in accordance with conventional practice. A basement wall is formed by installing and connecting together prefabricated wall panels 328, which may be similar to wall panels 30 or 100 or any other of the wall panels hereinbefore described, as modified as discussed hereinafter. A concrete or other suitable basement floor 316 is laid up to and in sealing engagement with the basement wall in accordance with conventional practice. A suitable waterproof wrap, illustrated at 318, is provided over the exterior surface of the basement wall. A hollow core floor slab 320 is supported by the basement wall panels 328. A first floor wall comprised of prefabricated wall panels 330, which may be similar to wall panels 30 or 100 or any other of the wall panels hereinbefore described including planar portions 301 with rebar reinforcements 303 and including vertical ribs 305, as modified as discussed hereinafter, is supported by the floor slab 320. These wall panels 330 desirably have brick or stone finishes, illustrated at 307, or the like on their external surfaces. The second floor (if desired) and, if desired, additional floors may be constructed similarly using a floor slab 320 supported by the wall beneath and wall panels 330 supported thereon. A suitable filler and facade, such as, for example, Dryvit, are illustrated at 322 and 324 respectively for trimming the joints between the floors and walls. A ceiling slab 326 is supported by the second or upper floor wall panels 330 by means of a header 332, and roof joists 334, sheathing 336, and shingles 338 are applied in accordance with conventional practice. As used herein and in the claims, the term "floor slab" is meant to include structures such as ceiling slab 326 which define ceilings as well as structures such as floor slabs 320 which define floors.

Figure 12:
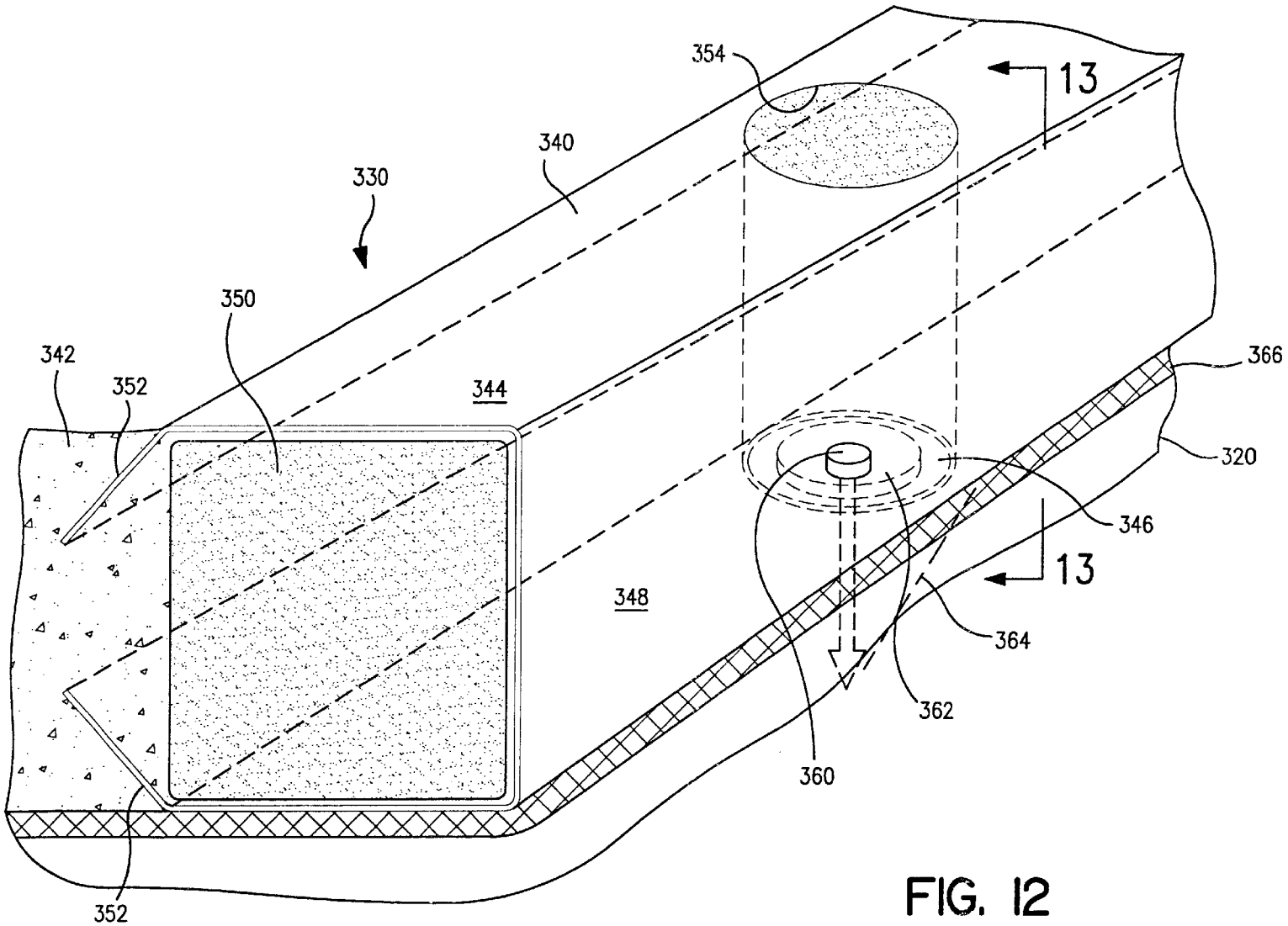
FIG. 12 is a partial perspective view illustrating the connection of a panel to a floor slab of the building.
Figure 13:
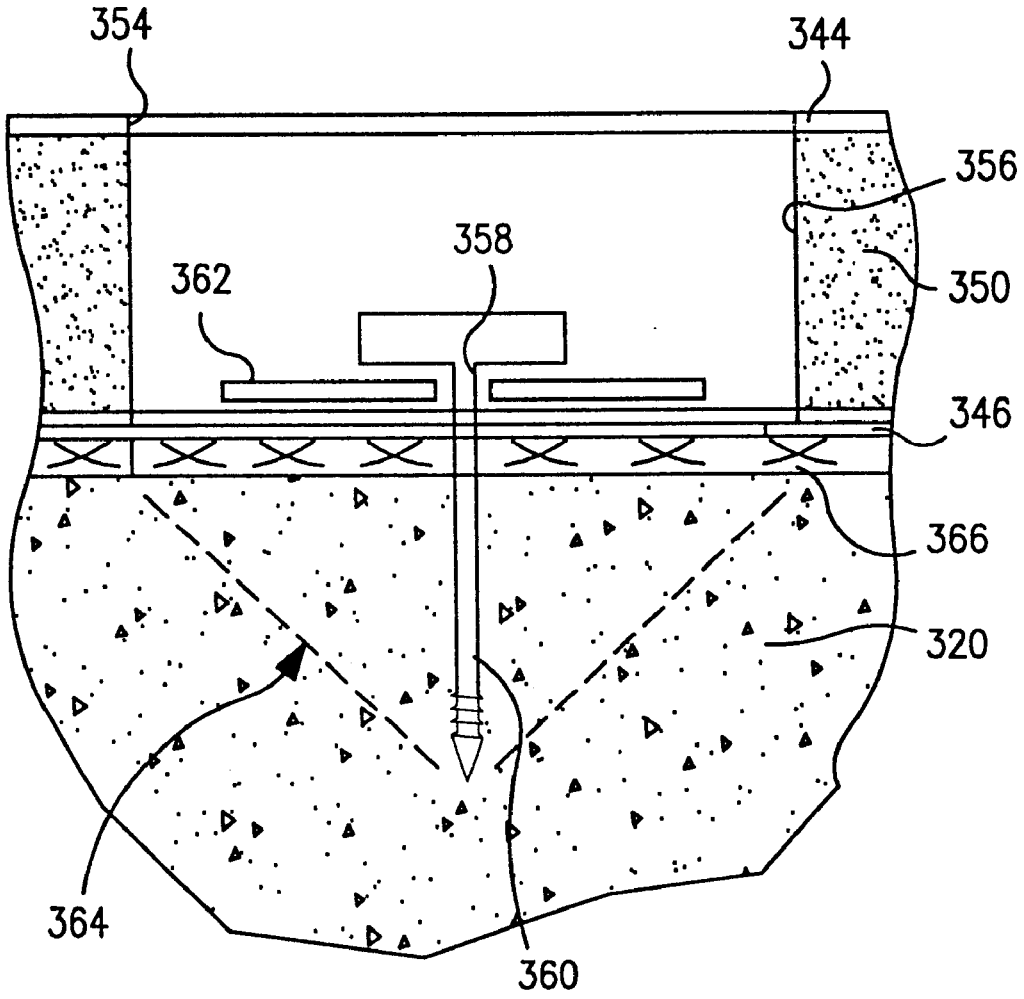
FIG. 13 is a sectional view taken along lines 13—13 thereof.
Figure 14:
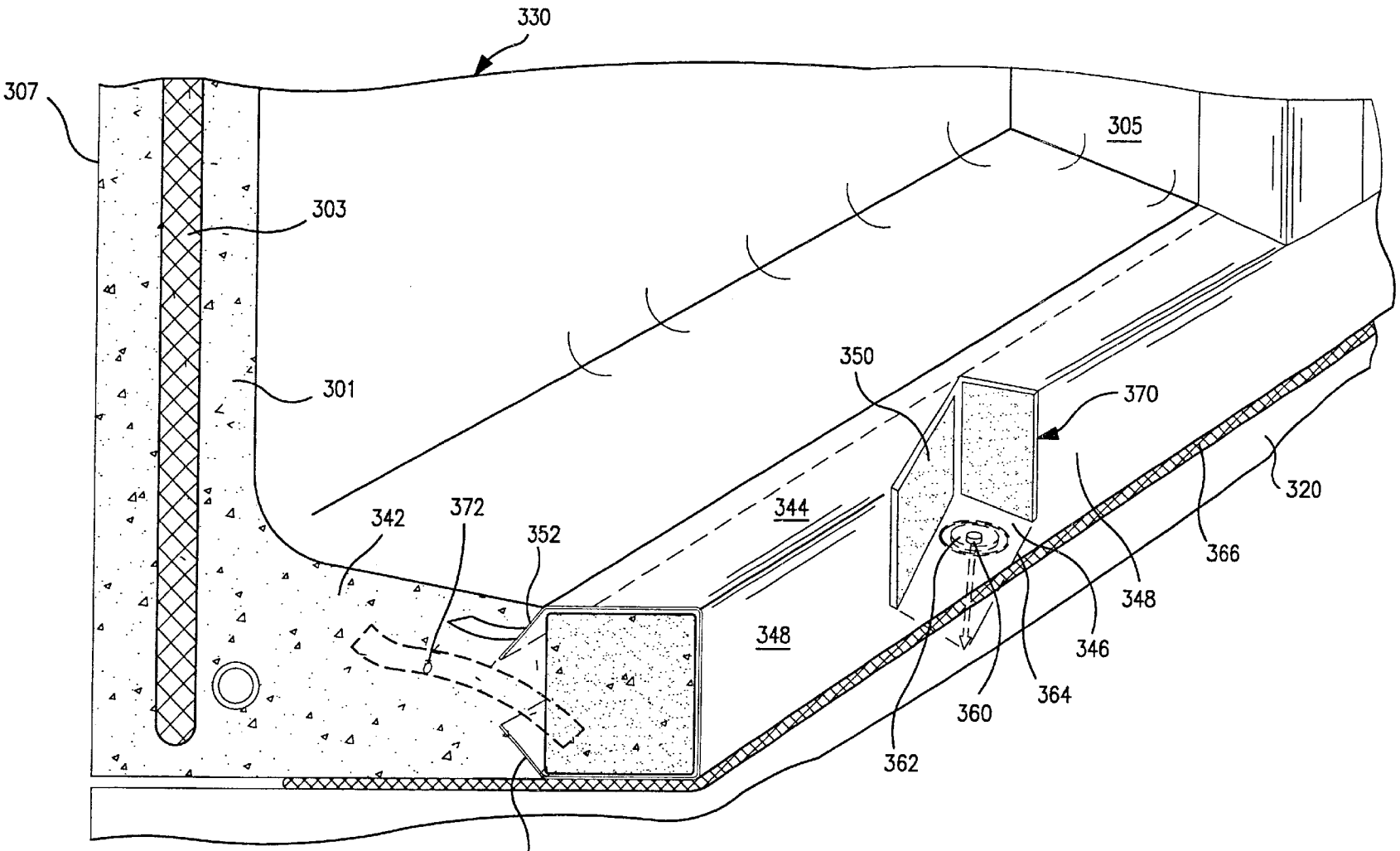
FIGS. 14 and 15 are views similar to that of FIG. 12 of two alternative means respectively of connection of a panel to a floor slab of the building.

A rigid weld plate system for connecting a wall panel to a floor slab is not only undesirably thermally conductive but also does not provide the flexibility of movement therebetween to withstand seismic and wind shocks and the like. Referring to FIGS. 12 and 13, in order to provide a seismic and wind shock resistant connection which allows some movement between the wall panels 328 and 330 and the respective floor slabs 320 and 326 so that the connection therebetween is adequately strong but not rigid, in accordance with the present invention the nailer member 340, which may be similar to nailer member 82, for the respective upper or lower horizontally-extending rib 342 is attached to the respective floor slab at one or more spaced locations (one shown in FIG. 12) along its length. While FIG. 12 shows the attachment of the lower rib of an upper wall panel to a lower floor slab and is therefore described accordingly, it should be understood that a wall panel may be similarly attached to an upper floor slab, and such an embodiment is meant to be included in the scope of the present invention. The nailer member 340 is shown in FIG. 12 to have upper and lower portions 344 and 346 respectively as well as inner portion 348 which extend about the upper, lower, and inner sides of the strip of insulating material 350, which may be similar to insulating material strip 78, and to have terminal edge portions 352 which are embedded in the concrete rib 342.

In order to securely attach the nailer 340 to the floor slab 320, an access hole is provided by means of a cut-out, illustrated at 354, in the upper nailer side 344 and a cylinder of the insulation strip 350 removed such as by drilling to define a bore, illustrated at 356, which extends downwardly to the lower nailer side 346 thereby allowing access thereto. A hole, illustrated at 358, is formed or pre-formed in the nailer side 346 to receive a suitable masonry nail 360 which is then securely nailed into the concrete material of the floor slab 320. A washer 362 is provided between the nail head and the nailer side 346. The nail length is such as to provide a sufficiently large shear cone, illustrated by dashed lines 364, for example, one of at least about 45 degrees, for adequate strength. Since wall board is attached to the inner portion 348 of the nailer, the connection between the wall panel and the floor slab is desirably hidden from view. The removed insulation material may, if desired, be replaced.

In order to allow some movement between the nailer 340 and the floor slab 320, in accordance with the present invention, a blanket 366 of a cushion material is disposed therebetween. This material 366 may be of any suitable load-bearing material such as plastic or wood which allows some movement between the wall panel and floor slab. Material 366 is also desirably of a type which is thermally insulative so as to provide a thermal break between the nailer 340 and the floor slab 320. This material 366 may, for example, be rubber, asphaltic, masonite, or other suitable material.

It should be understood that access to the lower nailer portion 346 so that it may be nailed or otherwise suitably attached to the floor slab 320 may be provided by other suitable means, which are also meant to come within the scope of the present invention. Thus, for example, referring to FIG. 14, a section, illustrated at 370, which is shown to be wedge-shaped but may otherwise be suitably shaped, is cut through the upper and inner nailer sides 344 and 348 respectively, and a corresponding chunk of the insulating strip 350 is removed.

At 372 is illustrated an embedment tab which is provided for the purpose of providing additional embedment to prevent nailer pull-out.

Figure 15:
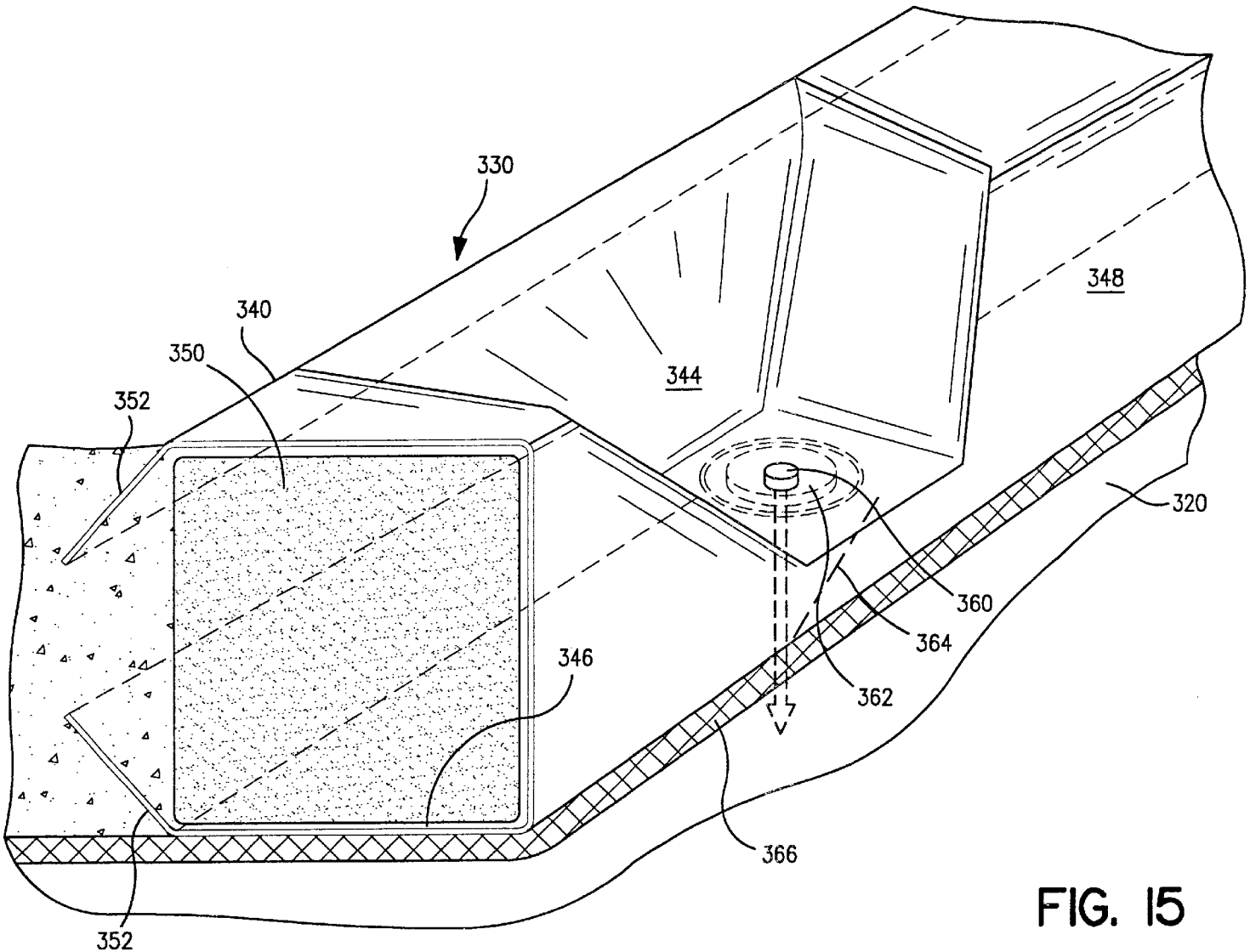

FIG. 15 illustrates another embodiment for providing means for nailing or otherwise suitably attaching the nailer 340 to the floor slab 320. In this embodiment, part of the upper nailer portion 344 is collapsed downwardly onto the lower nailer portion 346 such as by use of a crushing tool or device. Aligned holes for the nail 360 are provided in both nailer portions 344 and 346. The nail 360 is inserted therein and driven through the cushion material 366 and into the concrete material of the floor slab 320.

Figure 17:
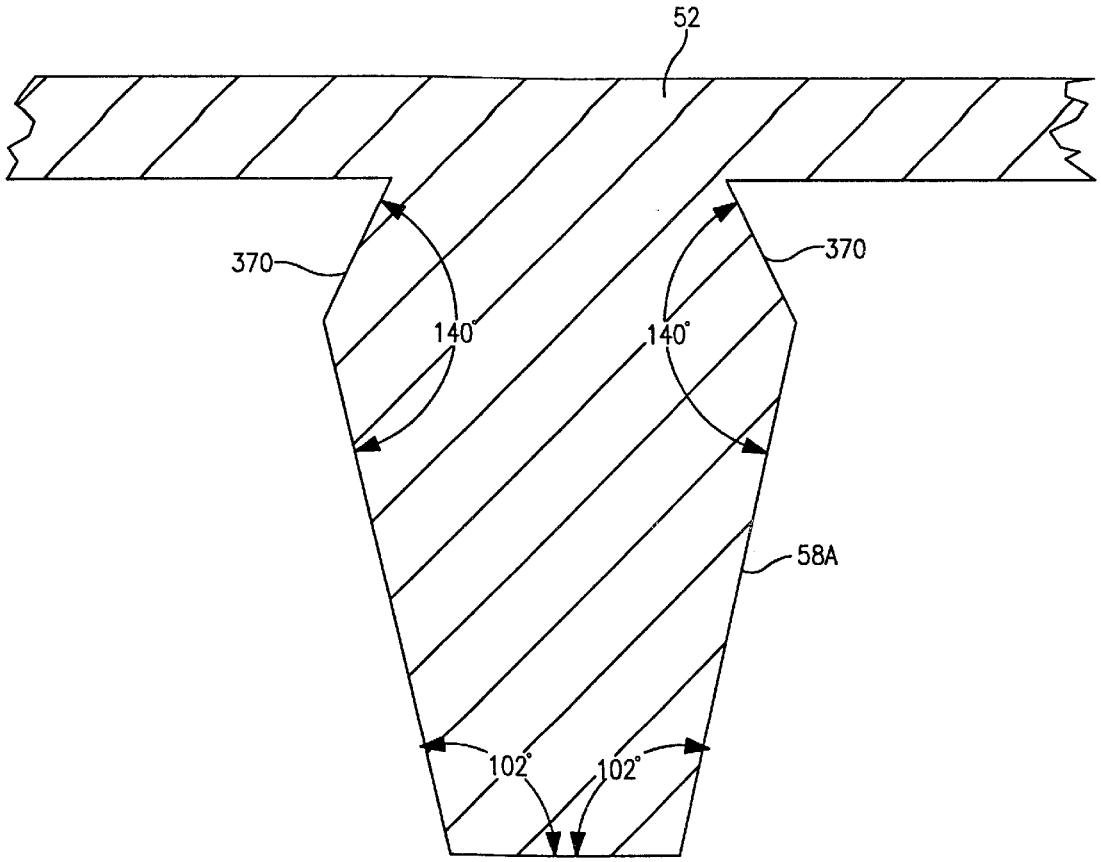
FIG. 17 is a horizontal sectional view, similar to FIG. 2, and showing an alternative embodiment of a stud element useful in the present invention.

It should be understood that, while the present invention has been described in detail herein, the invention can be embodied otherwise without departing from the principles thereof. For example, as illustrated in FIG. 17, the stud or rib portion 58A may be formed with side cuts 370 adjacent where the rib portion 58A joins the planar portion 52 without appreciably sacrificing the load-bearing capability of the structure. Providing the rib or stud element with side cuts has an advantage of reducing thermal transfer.

Figure 18:
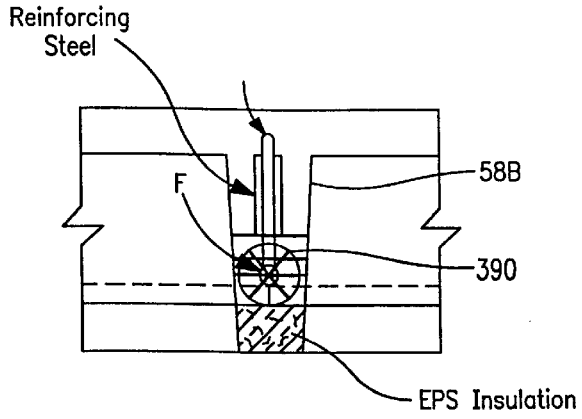
FIG. 18 is a view similar to FIG. 17, and showing yet another alternative embodiment of a stud portion of the present invention.

Referring to FIG. 18, in another embodiment of the invention, a plastic, ceramic or steel utility chase is provided within the stud or rib portion 58B to act as a passageway for conduit, pipe or other utilities within the wall. Typically, utility chase 390 will be located at a predetermined distance from the upper or lower edge of the panel, the exact height of which may be determined by local building codes. Utility chase 390 may be formed of an inert material, for example, plastic, ceramic, or the like and generally is molded in place.

Still other embodiments are possible.

What is claimed is:

1. A method of making a wall panel for attachment to like wall panels for building a wall, the method comprising the steps of:

(a) providing a mold for casting a concrete member having a generally planar portion including an inner surface and an outer surface and a plurality of rib portions extending from the inner surface to an edge of each respective rib portion, (b) nesting at least one insulation strip within a respective spring member so that each respective spring member extends about sides of each respective at least one insulation strip and terminates in end portions which extend inwardly relative to the sides of each respective at least one insulation strip, (c) covering the end portions of each respective spring member with a thermally insulating material to limit thermal conductivity from each respective rib portion of the concrete body to each respective strip member, (d) selecting each respective spring member to be biased against respective walls of a mold portion corresponding to each respective rib portion of the concrete member when each respective at least one nested insulation strip is inserted therein, (e) inserting each respective spring member with the at least one nested insulation strip in the mold portion, and (f) casting the concrete member in the mold with each respective spring member with the at least one insulation strip being unitarily attached to each respective rib portion edge of the concrete member with the thermally insulated end portions of each respective spring member being anchored in each respective rib portion of the concrete member to make a wall panel.

2. A method according to claim 1, wherein the mold is shaped so that a wall of at least one outer rib portion of the plurality of rib portions is tapered, the method further comprising forming an aperture in the at least one outer rib portion for receiving a bolt for attaching the wall panel to a like wall panel and the step of casting the concrete member in the mold further comprising casting a recess in the at least one outer rib portion wall for presenting a squared surface for engaging a head of the bolt.

3. A method of making a wall panel for attachment to like wall panels for building a wall, the method comprising the steps of:

(a) providing a mold for casting a concrete body having a generally planar portion including an inner surface and an outer surface and a plurality of rib portions extending from the inner surface to an edge of each respective rib portion, (b) nesting at least one insulation strip within a respective nailer strip so that each respective nailer strip extends about side of each respective at least one insulation strip and terminates in end portions which extend inwardly relative to the sides of each respective at least one insulation strip, (c) covering the end portions of each respective nailer strip with a thermally insulating material to limit thermal conductivity from each respective rib portion of the concrete body to each respective nailer strip, (d) inserting each respective nailer strip with at least one nested insulation strip into the mold, and (e) casting the concrete body in the mold with each respective nailer strip with the at least one insulation strip being unitarily attached to each respective rib portion edge with the end portions of each respective nailer strip being anchored in each respective rib portion of the concrete body to make a wall panel.

* * * * *

UNITED STATES PATENT AND TRADEMARK OFFICE

CERTIFICATE OF CORRECTION

PATENT NO. : 6,280,669 B2
DATED : August 28, 2001
INVENTOR(S) : Kistner et al.

It is certified that error appears in the above-identified patent and that said Letters Patent is hereby corrected as shown below:

Column 12,
Line 40, “side” should be -- sides --
Line 48, insert “the” after -- with --

Signed and Sealed this

Twenty-fourth Day of September, 2002

*Attest:*

*Attesting Officer*

JAMES E. ROGAN
*Director of the United States Patent and Trademark Office*